US010579019B2

(12) United States Patent
Kitajima et al.

(10) Patent No.: US 10,579,019 B2
(45) Date of Patent: Mar. 3, 2020

(54) WATCH

(71) Applicant: CITIZEN WATCH CO., LTD., Tokyo (JP)

(72) Inventors: Yasuo Kitajima, Sayama (JP); Hiroyuki Takahashi, Saku (JP); Kyohei Miyajima, Tomi (JP); Yuichi Naito, Nagano-ken (JP)

(73) Assignee: Citizen Watch Co., LTD., Tokyo (JP)

( * ) Notice: Subject to any disclaimer, the term of this patent is extended or adjusted under 35 U.S.C. 154(b) by 181 days.

(21) Appl. No.: 15/739,129

(22) PCT Filed: Jan. 28, 2016

(86) PCT No.: PCT/JP2016/052493
§ 371 (c)(1),
(2) Date: Dec. 21, 2017

(87) PCT Pub. No.: WO2017/051547
PCT Pub. Date: Mar. 30, 2017

(65) Prior Publication Data

US 2019/0064740 A1 Feb. 28, 2019

(30) Foreign Application Priority Data

Sep. 25, 2015 (JP) ..... 2015-188338

(51) Int. Cl.
*G04B 29/02* (2006.01)
*G04C 3/00* (2006.01)
(Continued)

(52) U.S. Cl.
CPC ..... *G04B 29/02* (2013.01); *G04B 19/00* (2013.01); *G04B 19/04* (2013.01); *G04B 45/00* (2013.01); *G04B 45/0069* (2013.01); *G04C 3/00* (2013.01)

(58) Field of Classification Search
CPC ..... G04B 29/02; G04B 19/00; G04B 19/04; G04B 45/00; G04B 45/0069; G04B 19/10; G04B 33/08; G04C 3/00
(Continued)

(56) References Cited

U.S. PATENT DOCUMENTS 4,681,464 A * 7/1987 Ray ..... G04F 8/00 368/157
4,748,603 A * 5/1988 Ray ..... G04B 33/08 368/223
(Continued)

FOREIGN PATENT DOCUMENTS

CH 197634 A 5/1938
CN 2560009 Y 7/2003
(Continued)

OTHER PUBLICATIONS

English translation of the International Search Report for PCT/JP2016/052493.

*Primary Examiner* — Edwin A. Leon
(74) *Attorney, Agent, or Firm* — HEA Law PLLC

(57) ABSTRACT

A watch including: a first drive mechanism including a hand having a rotational axis along a first direction, a wheel train, and a drive power source; and a second drive mechanism including a hand having a rotational axis along a second direction different from the first direction, a wheel train, and a drive power source, wherein the first drive mechanism and the second drive mechanism are mounted separately. Each of the first direction and the second direction is defined along a normal direction to dial at a position of a rotational axis of the hand.

11 Claims, 8 Drawing Sheets

(51) Int. Cl.
*G04B 19/00* (2006.01)
*G04B 45/00* (2006.01)
*G04B 19/04* (2006.01)

(58) Field of Classification Search
USPC ..... 368/204
See application file for complete search history.

(56) References Cited

U.S. PATENT DOCUMENTS 4,788,669 A * 11/1988 Kamiyama ..... G04C 3/008 368/160
4,969,133 A * 11/1990 Triponez ..... G04C 3/008 368/80

FOREIGN PATENT DOCUMENTS

| | | | |
|---|---|---|---|
| CN | 101930209 | A | 12/2010 |
| JP | S51-88064 | A | 8/1976 |
| JP | S57-6380 | A | 1/1982 |
| JP | S57-41193 | U | 3/1982 |
| JP | S57-173781 | A | 10/1982 |
| JP | H09-21891 | A | 1/1997 |
| WO | 9012347 | A1 | 10/1990 |

* cited by examiner

WATCH

CROSS REFERENCE TO RELATED APPLICATIONS

This application is a National Stage of International Application No, PCT/JP2016/052493 filed on. Jan. 28, 2016, which claims priority from Japanese Patent Application 2015-188338, filed on Sep. 25, 2015. The contents of the above document is incorporated herein by reference in its entirety.

TECHNICAL FIELD

The present invention is related to a watch.

BACKGROUND ART

Conveniently, watches each including a curved dial and plural hand axes are known.

The patent document 1 described below discloses a wristwatch in which a hand axis of a main hand and a hand axis of a sub-hand are arranged in parallel and in which a curved dial and the sub-hand are not in parallel to each other.

CITATION LIST

Patent Literature

Patent Document 1: Switzerland Patent No. 197634

SUMMARY OF INVENTION

Technical Problem

The wristwatch described in the patent document 1 has a characteristic beauty presented by a curved case, but can cause an unnatural appearance because the rotational plane of the hand and the dial surface are not in parallel. For the problem, making the axis of the hand inclined in conformity with the dial surface might be effective. However, it is very difficult to arrange, in a narrow space, a mechanism that transmits movement power between rotational axes disposed at different inclinations. Even if the mechanism is built, it will significantly increase the manufacturing cost of product.

In view of such problems of the prior art as mentioned above, an object of the present invention is to provide a watch (portable timepiece) that enables an easy manufacturing and includes a hand having a rotational axis thereof along a direction inclined in conformity with the dial surface.

Solution to Problem

An invention disclosed in the present application for solving the problem described above has various aspects. A summary of typical aspect of those is as follows.

(1) A watch comprises: a first drive mechanism that includes a hand having a rotational axis along a first direction, a wheel train, and a drive power source; and a second drive mechanism that includes a hand having a rotational axis along a second direction different from the first direction, a wheel train, and a drive power source, wherein the first drive mechanism and the second drive mechanism are mounted separately.

(2) In an aspect of (1), each of the first direction and the second direction is defined along a normal direction to a dial at a position of the rotational axis of the hand.

(3) In an aspect of (1) or (2), each of the first drive mechanism and the second drive mechanism is configured to be independently and integrally mounted on, and removed from, the watch.

(4) An aspect of (3) further comprises a main plate including a first attachment surface and a second attachment surface having different orientations from each other, wherein the first drive mechanism is fixed such that a standard surface thereof is in contact with the first attachment surface, and the second drive mechanism is fixed such that a standard surface thereof is in contact with the second attachment surface.

(5) In an aspect of (4), the main plate includes at least a first recess and a second recess, a bottom surface of the first recess is the first attachment surface, and a bottom surface of the second recess is the second attachment surface.

(6) In an aspect of (5), the first recess and the second recess include wall surfaces that are formed in parallel to a common direction or formed like a taper inclined from a common direction.

(7) In an aspect of (5) or (6), the first recess and the second recess are formed on surfaces of the main plate opposite to each other.

(8) In an aspect described in anyone of (1) to (6), the main plate further includes a battery accommodating portion that is a recess, and a battery disposed inside the battery accommodating portion is fixed in a posture inclined from the thickness direction of the watch.

(9) In an aspect of (6) or (7), the main plate further includes a battery accommodating portion that is a recess, a battery disposed inside the battery accommodating portion is fixed in a posture inclined from the thickness direction of the watch, and the battery accommodating portion includes a wall surface that is formed in parallel to the common direction or formed like a taper inclined from the common direction.

(10) An aspect of (8) or (9) further comprises: a first battery pressing member located on a near side when viewed from an opening side of the battery accommodating portion, located at a circumferential position thereof, and supporting an upper surface of the battery; and a second battery pressing member located on a far side when viewed from the opening side of the battery accommodating portion, and pressing a lateral side surface of the battery.

(11) The potable watch described in anyone of (8) to (10) further comprises a tongue-like electrode including a linear distal edge that is oblique from an extending direction thereof and is in elastic contact with a lower surface of the battery.

(12) In an aspect of anyone of (1) to (11), the first drive mechanism and the second drive mechanism include circuit boards, respectively, and the circuit board of the first drive mechanism and the circuit board of the second drive mechanism are connected to each other through a FPC (Flexible Printed Circuit).

(13) In an aspect of (12), the circuit board of the first drive mechanism and the circuit board of the second drive mechanism include connection terminals, respectively.

Advantageous Effects of Invention

The aspect of (1) of the present invention provides a watch that enables an easy manufacturing and includes a hand having a rotational axis thereof along a direction inclined in conformity with the dial surface.

The aspect of (2) of the present invention provides a watch that prevents an interference between the hand and the dial and that increases freedom in the arrangement of the hand and in the design of the hand.

The aspect of (3) of the present invention provides a watch that is easily manufactured by a process in which the unified drive mechanisms are assembled.

The aspect of (4) of the present invention provides a watch in which the inclination angles of the drive mechanisms are accurately fixed.

The aspect of (5) of the present invention provides a watch that enables an easy assembling and is a thin type.

The aspect of (6) of the present invention provides a watch a main plate of which enables an easy injection molding.

The aspect of (7) of the present invention provides a watch that includes a sub-hand at a position overlapping with a winding stem.

The aspect of (8) of the present invention enables the battery to be disposed inside the main plate and along the curvature of the main plate, which makes a wristwatch be a thin type.

The aspect of (9) of the present invention provides a watch which not only enables the battery to be disposed inside the main plate and to be arranged along the curvature of the main plate and makes the wristwatch be a thin type, but also enables the main plate to facilitate an injection molding.

The aspect of (10) of the present invention enables the battery to be stably fixed and ensures an electrical conductivity to the battery, in a watch including an inclined dial surface.

The aspect of (11) of the present invention provides a watch that not only enables an electrode thereof to be in line contact with an accommodated and inclined battery and stabilizes an electric conductivity, but also prevents a damage due to a torsion force.

The aspect of (12) of the present invention provides a watch in which the drive mechanisms are stably fixed and which includes circuit boards easily mounted in a curved surface.

The aspect of (13) of the present invention provides a watch in which each drive mechanism has a stable ground potential provided thereto.

DESCRIPTION OF EMBODIMENTS

Hereinafter, embodiments according to the present invention will be described with reference to the drawings.

Figure 1:
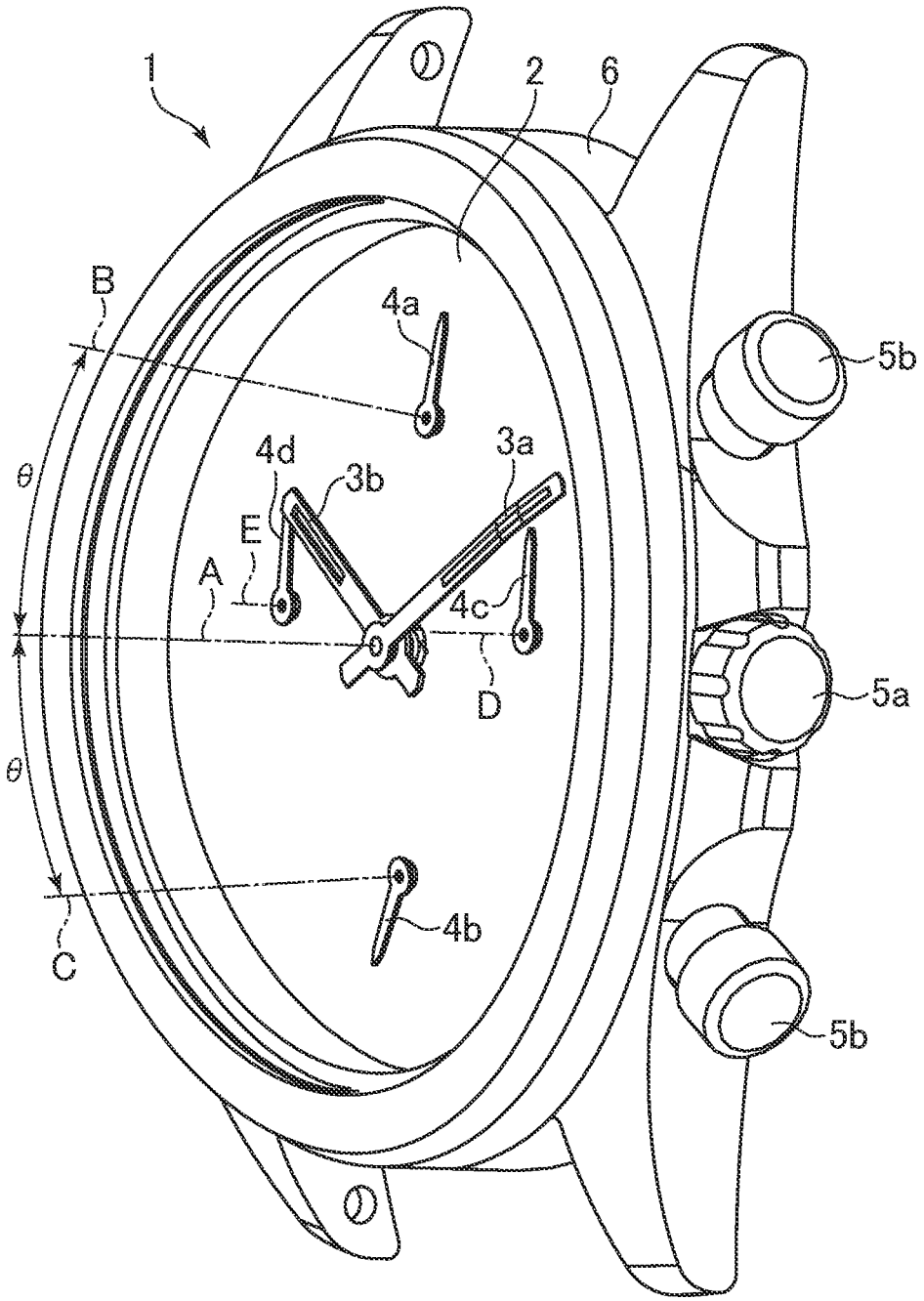
FIG. 1 illustrates an exampled appearance of a wristwatch according to an embodiment of the present invention.

FIG. 1 shows an exampled appearance of a wristwatch 1 according to an embodiment of the present invention. The figure shows a dial 2 disposed in a body 6 of the wristwatch 1, an hour hand 3*a* and a minute hand 3*b* that indicate time, a first sub-hand 4*a*, a second sub-hand 4*b*, a third sub-hand 4*c*, and a fourth sub-hand 4*d*. The first sub-hand 4*a* is located in the 12 o'clock direction, the second sub-hand 4*b* is located in the 6 o'clock direction, the third sub-hand 4*c* is located in the 3 o'clock direction, and the fourth sub-hand 4*d* is located in the 9 o'clock direction. The first sub-hand 4*a*, the second sub-hand 4*b*, the third sub-hand 4*c* and the fourth sub-hand 4*d* are used, for example, for indicating time in the form of 24-hour clock and for indicating chronograph. Further, a crown 5*a* and push buttons 5*b* for a user of the wristwatch 1 to perform various operations are located on a side surface of the body 6.

In the wristwatch 1, a wind shield made of a transparent material such as glass is attached to the body 6, covering the dial 2. Further, a back lid on the side opposite to the wind shield is attached to the body 6. In the present specification, the side on which the wind shield of the wristwatch 1 is disposed will be hereinafter referred to as "front side", and the side on which the back lid is disposed will be hereinafter referred to as "back side".

The dial 2 in the present embodiment is gently curved bulging toward the front side. The body 6 is also curved like the dial 2 and thus has a shape to conform to the curvature of the user's arm when the wristwatch 1 is worn on the arm. FIG. 1 illustrates a rotational axis A of the hour hand 3*a* and the minute hand 3*b*, a rotational axis B of the first sub-hand 4*a*, a rotational axis C of the second sub-hand 4*b*, a rotational axis D of the third sub-hand 4*c* and a rotational axis E of the fourth sub-hand 4*d*. Each of the rotational axis A, the rotational axis B, the rotational axis C, the rotational axis D, and the rotational axis E is along the normal direction perpendicular to the dial 2. Each of the rotational axis B and the rotational axis C is not parallel to the rotational axis A. The angle between the rotational axis A and the rotational axis B and the angle between the rotational axis A and the rotational axis C are θ. The angle θ may be larger than 0° and smaller than 90°. In the wristwatch 1 according to the present embodiment, the angle θ is about several degrees. In the present specification, the direction along the rotational axis A is referred to as a first direction, and the direction along the rotational axis B is referred to as a second direction. In the wristwatch 1 according to the present embodiment, both angle between the rotational axis A and the rotational axis B and angle between the rotational axis A and the rotational axis C are θ. However, these angles may be different from each other. Making the difference between the two angles, that is, the angle between the rotational axis A and the rotational axis B and the angle between the rotational axis A and the rotational axis C, permit more varied designs.

The design of the wristwatch 1 shown in FIG. 1 is an example. For example, unlike the design shown in the figure, the body 6 may be a square rather than a round shape, and the curvature of the dial 2 may be changed such that the angles θ are larger or smaller than that shown in FIG. 1. The crown 5*a* and the push buttons 5*b* may be omitted. The number, the positions, and absence/presence of the crown 5*a* and the push buttons 5*b* are freely determined. In the present embodiment, the number of the hands is two including the hour hand 3*a* and the minute hand 3*b*. However, the number of the hands are not limited to two. A hand that indicates the second of time may be added to the hands. In addition, the first sub-hand 4*a*, the second sub-hand 4*b*, the third sub-hand 4*c*, and the fourth sub-hand 4*d* may indicate a day of week, the remaining power of the battery, and various other information. The number of the sub-hands may be increased or reduced, and the positions of the sub-hands may be changed.

Figure 2:
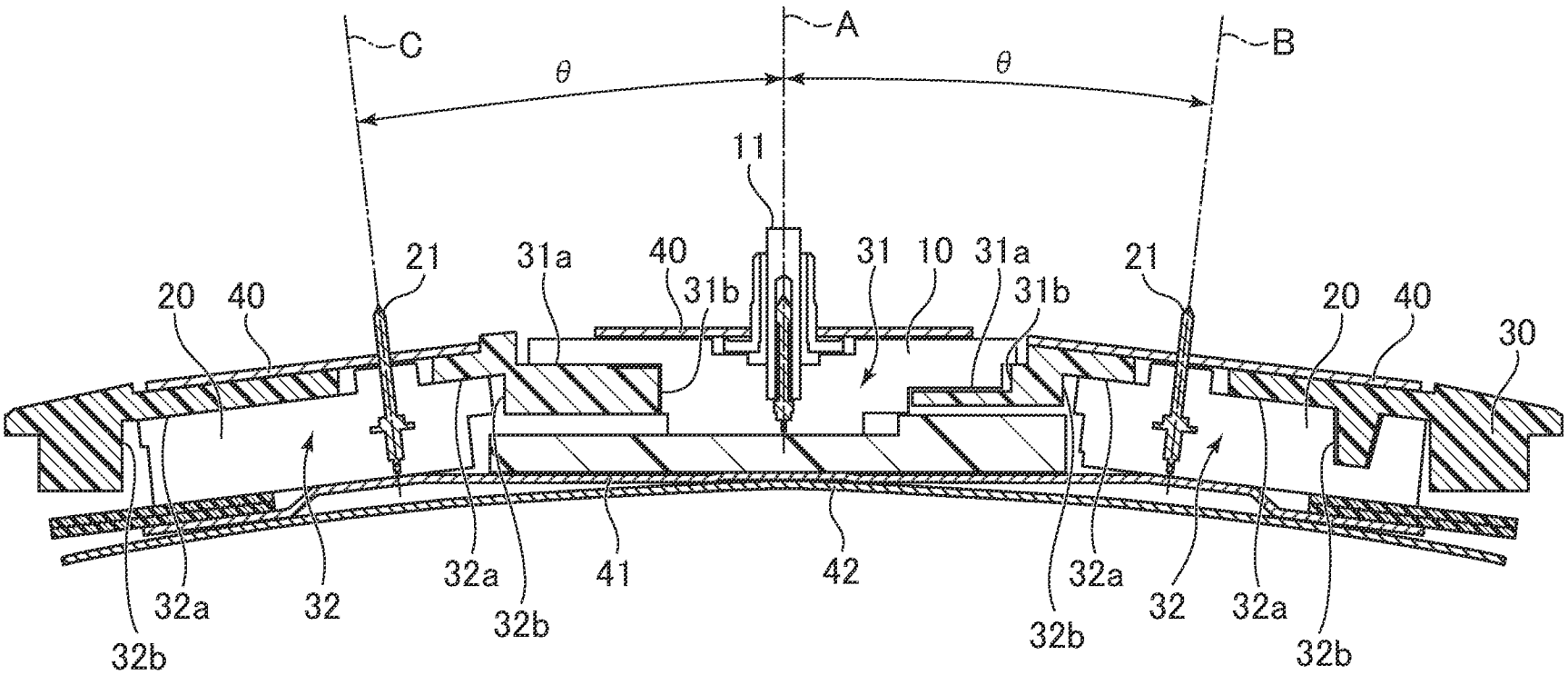
FIG. 2 is a cross-sectional view of the wristwatch according to the embodiment of the present invention.

FIG. 2 is a cross-sectional view of the wristwatch 1 according to the embodiment of the present invention. The figure shows a first drive mechanism 10 and second drive mechanisms 20 each disposed in a main plate 30, and a first support plate 40 pressing the front side of the first drive mechanism 10 to fix the first drive mechanism 10. Further, the figure shows a second support plate 41 and a third support plate 42 pressing the back side of the second drive mechanisms 20 to fix the second drive mechanisms 20. The first drive mechanism 10 includes a first hand shaft 11, and the second drive mechanism 20 includes a second hand shaft 21.

The wristwatch 1 according to the present embodiment includes the first drive mechanism 10 including a hand having the rotational axis A along the first direction, a wheel train and a drive power source, and includes the second drive mechanisms 20 including a hand having the rotational axis B along the second direction different from the first direction, a wheel train and a drive power source. The first drive mechanism 10 and the second drive mechanisms 20 are mounted separately on the wristwatch 1. The first drive mechanism 10 includes the first hand shaft 11 that is the hand axis of the hour hand 3*a* and the minute hand 3*b*. The first hand shaft 11 is driven by the drive power source via the wheel train in the first drive mechanism 10. The second drive mechanism 20 includes the second hand shaft 21 that is the hand axis of the first sub-hand 4*a*. The second hand shaft 21 is driven via the wheel train by the drive power source of the second drive mechanism 20 that is independent of the drive power source of the first drive mechanism 10. The hands (that is, the hour hand 3*a* and the minute hand 3*b*) of the first drive mechanism 10 and the hand (that is, the first sub-hand 4*a*) of the second drive mechanism 20 are mounted to a common dial surface. That is, the hands of the first drive mechanism 10 and the hand of the second drive mechanism 20 are not mounted to plural dial surfaces, respectively, but mounted to a common dial surface so that a user is allowed to simultaneously see the hands of the first drive mechanism 10 and the hand of the second drive mechanism 20.

A structure in which the first drive mechanism 10 for driving the hour hand 3*a* and the minute hand 3*b* and the second drive mechanism 20 for driving the first sub-hand 4*a* are composed separately from one another eliminates necessity for a mechanism that transmits power to the plural hand axes that have different orientations, and thus provides the watch in which the rotational axes of the hands are inclined in conformity with the dial surface while facilitating the manufacturing of the watch. The structure in which the drive mechanisms are separated for the plural hand axes is beneficial especially for electrical watches, whereas the structure is difficult to be mounted in mechanical watches, which are difficult to include plural drive power sources.

As described above, each of the first direction (the direction along the rotational axis A) and the second direction (the direction along the rotational axis B) is defined along the normal direction to the dial 2. Though the dial 2 is omitted from the cross-sectional view of FIG. 2, the dial 2 is formed in conformity with the curvatures of the main plate 30 and the first support plate 40 so as to cover the main plate 30 and the first support plate 40. Each of the first direction (the direction along the rotational axis A) and the second direction (the direction along the rotational axis B) is also a direction along the normal line that is positioned at the rotational axis of the hand and that is perpendicular to the first support plate 40. In the above description, the direction along the normal line means not only a direction identical to the normal direction, but also directions that ranges from the normal direction between given angles (for example, between plus and minus five degrees). Note that, the range of the angles may exceed the range between plus and minus five degrees. The range of the angles may be determined so as to avoid an interference between the hand and the dial or may be determined in consideration of the arrangement of the wheel trains for driving the hands.

Since the first direction and the second direction is respectively defined along the normal lines that is perpendicular to the dial 2 and that is located at the positions of the rotational axes of the hands, the hand axes 11, 21 are defined substantially perpendicular to the dial 2 and thus each of the plural hands is arranged substantially in parallel to the dial. Therefore, the hands and the dial are prevented from causing an interference therebetween, and freedom in arrangement of the hands and freedom in design thereof can be improved.

Each of the first drive mechanism 10 and the second drive mechanism 20 is configured to be independently and integrally mounted to, removed from, the wristwatch 1 according to the present embodiment. Each of the first drive mechanism 10 and the second drive mechanism 20 is a unit component that operates individually. Accordingly, the wristwatch 1 can be easily manufactured by combining the drive mechanisms each unified. The structure related to the benefit mentioned here will be described in detail with reference to FIGS. 3 to 6.

The wristwatch 1 according to the present invention includes a main plate 30 including a first attachment surface 31*a* and second attachment surfaces 32*a* that have different orientations from each other. The first drive mechanism 10 is fixed such that the standard surface thereof is in contact with the first attachment surface 31*a*. The standard surface of the first drive mechanism 10 is a flat surface formed on a side opposite to a side from which the first hand shaft 11 projects. The second drive mechanisms 20 are fixed such that the standard surfaces thereof are in contact with the second attachment surfaces 32*a*. The standard surface of the second drive mechanism 20 is a flat surface formed on a side from which the second hand shaft 21 projects.

Each of the first attachment surface 31*a* of the main plate 30 and the standard surface of the first drive mechanism 10 according to the present embodiment is a flat surface. Accordingly, attaching the first drive mechanism 10 to the main plate 30 to make the two surfaces be in contact with each other enables the inclination angle of the first drive mechanism 10 to be accurate. Further, each of the second attachment surface 32*a* of the main plate 30 and the standard surface of the second drive mechanism 20 is a flat surface, and thus attaching the second drive mechanism 20 to the main plate 30 to make the two surfaces thereof be in contact with each other enables the inclination angle of the second drive mechanism 20 to be accurate. The first attachment surface 31*a* and the second attachment surface 32*a* are formed in the main plate 30, being inclined from each other by the angle θ. Therefore, when the first drive mechanism 10 is fixed such that the first attachment surface 31*a* and the standard surface of the first drive mechanism 10 are in contact with each other and when the second drive mechanisms 20 are fixed such that the second attachment surfaces 32*a* and the standard surfaces of the second drive mechanisms 20 are in contact with each other, the angle θ is made between the rotational axis A and the rotational axis B and between the rotational axis A and the rotational axis C. If the first attachment surface 31*a* and the second attachment surfaces 32*a* described above are not formed on the main plate 30 and thus the inclination angle of the first drive mechanism 10 and the inclination angles of the second drive mechanisms 20 need to be adjusted in the manufacturing process, it is necessary for a manufacture to attach the first drive mechanism 10 and the second drive mechanisms 20 to the main plate 30 such that each of the first hand shaft 11 and the second hand shafts 21 is perpendicular to the dial 2 (or the first support plate 40) and such that the angles θ are secured between the rotational axis A and the rotational axis B and between the rotational axis A and the rotational axis C, which complicates the manufacturing process. Contrary to that, in the wristwatch 1 according to the present embodiment, it is not necessary to adjust the inclination angles when the first drive mechanism 10 and the second drive mechanisms 20 are attached to the main plate 30, which facilitates the manufacturing process. Note that, the first attachment surface 31*a*, the standard surface of the first drive mechanism 10, the second attachment surface 32*a*, and the standard surface of the second drive mechanism 20 may not be flat surfaces and may be surfaces having a projection and a recess fitting to each other.

The main plate 30 according to the present embodiment includes at least a first recess 31 and second recesses 32. The bottom surface of the first recess 31 is the first attachment surface 31*a*. The bottom surface of the second recess 32 is the second attachment surface 32*a*. The first drive mechanism 10 is disposed inside, and attached to, the first recess 31 of the main plate 30. The second drive mechanism 20 is disposed inside, and attached to, the second recess 32 of the main plate 30. As the first drive mechanism 10 is disposed inside the first recess, the standard surface of the first drive mechanism 10 is in contact with the bottom surface (the first attachment surface 31*a*) of the first recess 31. Further, as the second drive mechanism 20 is disposed inside the second recess 32, the standard surface of the second drive mechanism 20 is in contact with the bottom surface (the second attachment surface) of the second recess 32.

The structure in which the first drive mechanism 10 and the seconds drive mechanisms 20 are disposed inside the first recess 31 and the second recesses 32, respectively, reduces the thickness thereof and makes the thickness of the whole wristwatch 1 smaller than that in a structure where the first drive mechanism 10 and the seconds drive mechanisms 20 are disposed on a flat main plate. Further, the first recess 31 and the second recesses 32 indicate the attachment positions and the attachment direction of the first drive mechanism 10 and the second drive mechanisms 20, which facilitates the manufacturing process.

The first recess 31 and the second recesses 32 include wall surfaces formed in parallel to a common direction or formed like a taper inclined from a common direction. More specifically, the first recess 31 includes a first wall surface 31*b* formed like a taper inclined from the first direction (the direction along the rotational axis A). Further, the second recess 32 includes a second wall surface 32*b* formed like a taper inclined from the first direction (the direction along the rotational axis A). The first wall surface 31*b* has a taper the internal dimension of which becomes wider toward the front side. The second wall surface 32*b* has a taper the internal dimension of which becomes wider toward the back side.

If the wall surface of the first recess 31 and the wall surface of the second recess 32 are formed perpendicular to the attachment surfaces (that is, the first attachment surface 31*a* and the second attachment surface 32*a*), difficulty is caused in the manufacturing process because it is difficult for dies to be removed from the molded main plate 30 in injection molding. Contrary to that, the structure in which the first recess 31 and the second recess 32 include the wall surfaces formed in parallel to the common direction or formed like a taper inclined from the common direction enables removing the dies from the molded main plate 30 in the same common direction. Therefore, it is possible to manufacture the main plate 30 by injection molding, which improves productivity for the main plate 30 to reduce the cost and the time necessary in manufacturing the main plate 30. The first recess 31 and the second recesses 32 that include the wall surfaces formed as tapers having so-called drafts inclined from the common direction facilitate the injection molding.

In the main plate 30 according to the present embodiment, the first recess 31 and the second recesses 32 are formed on sides of the main plate 30 opposite to each other. More specifically, the first recess 31 is formed on the front side of the main plate 30. The second recesses 32 are formed on the back side of the main plate 30. This structure will be described in detail with reference to FIG. 3.

Figure 3:
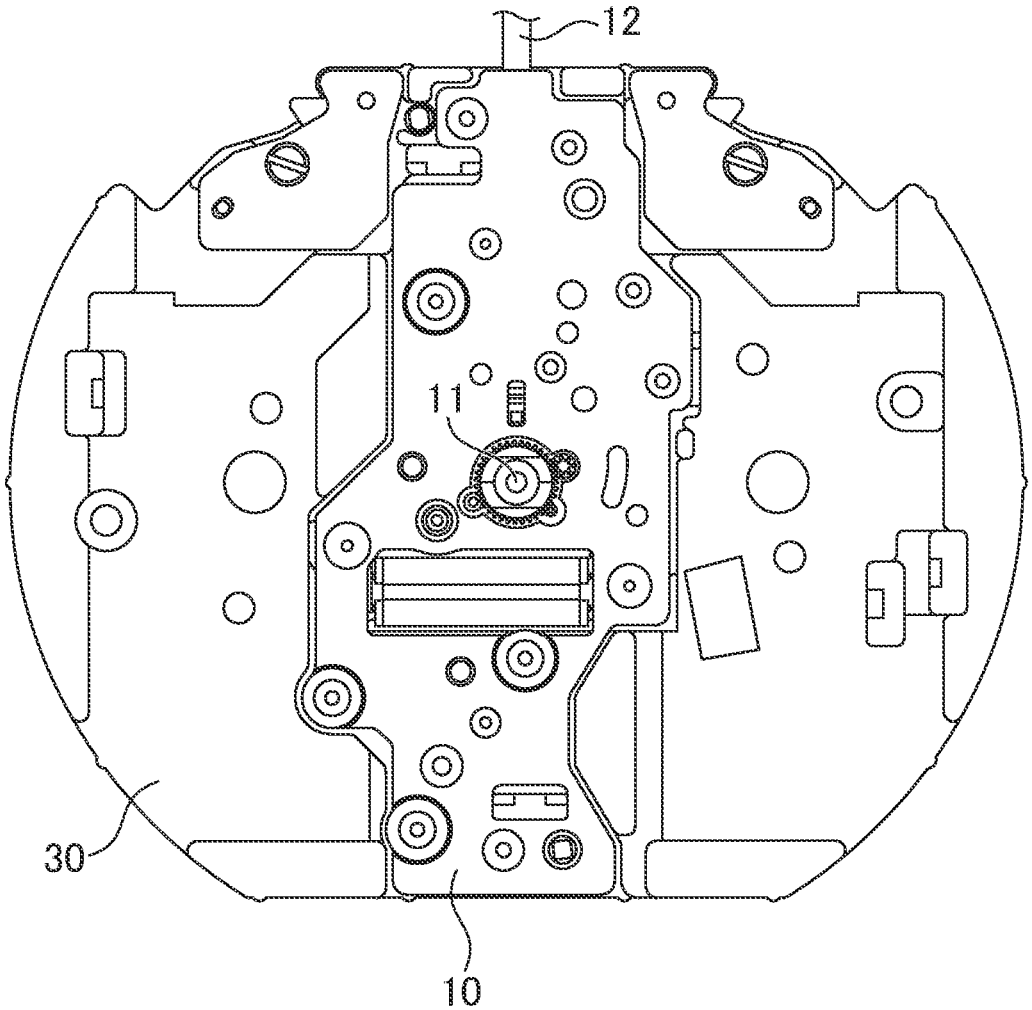
FIG. 3 is a plan view that illustrates, on a side where a dial is located, an internal structure of the wristwatch of the embodiment according to the present invention.

FIG. 3 is a plan view that illustrates, on the side where the dial 2 is located, the internal structure of the wristwatch 1 in the embodiment according to the present invention. FIG. 3 illustrates, on the side where the dial 2 is located, the wristwatch 1 with the 3 o'clock direction thereof directed to the upper side of the figure. The first drive mechanism 10 includes a winding stem 12. The winding stem 12 is mainly used for setting the time indicated through the first hand shaft 11. The crown 5*a* shown in FIG. 1, which is omitted in FIG. 3, is attached to the distal end of the winding stem 12.

As shown in FIG. 3, the first drive mechanism 10 includes the winding stem 12. The winding stem 12 protrudes to the outside. The first support plate 40 shown in FIG. 2 is sometimes designed to spread, in the plan view, toward the outside beyond the outer edge of the drive mechanism 10 so as to equally presses the whole first drive mechanism 10. If all of the drive mechanisms are attached on the same side of the main plate 30, neighboring drive mechanisms need to have a sufficient margin therebetween in order to avoid an interference between the members that spread toward the outsides beyond the outer edges of the neighboring drive mechanisms, which increases the size of the wristwatch. In the wristwatch 1 according to the present embodiment, since the first recess 31 is formed on the front side and the second recesses 32 is formed on the back side, and thus the first drive mechanism 10 is attached on the front side and the second drive mechanisms 20 are attached on the back side, the distance between the drive mechanisms can be minimized and thus the wristwatch 1 can be downsized.

Figure 4:
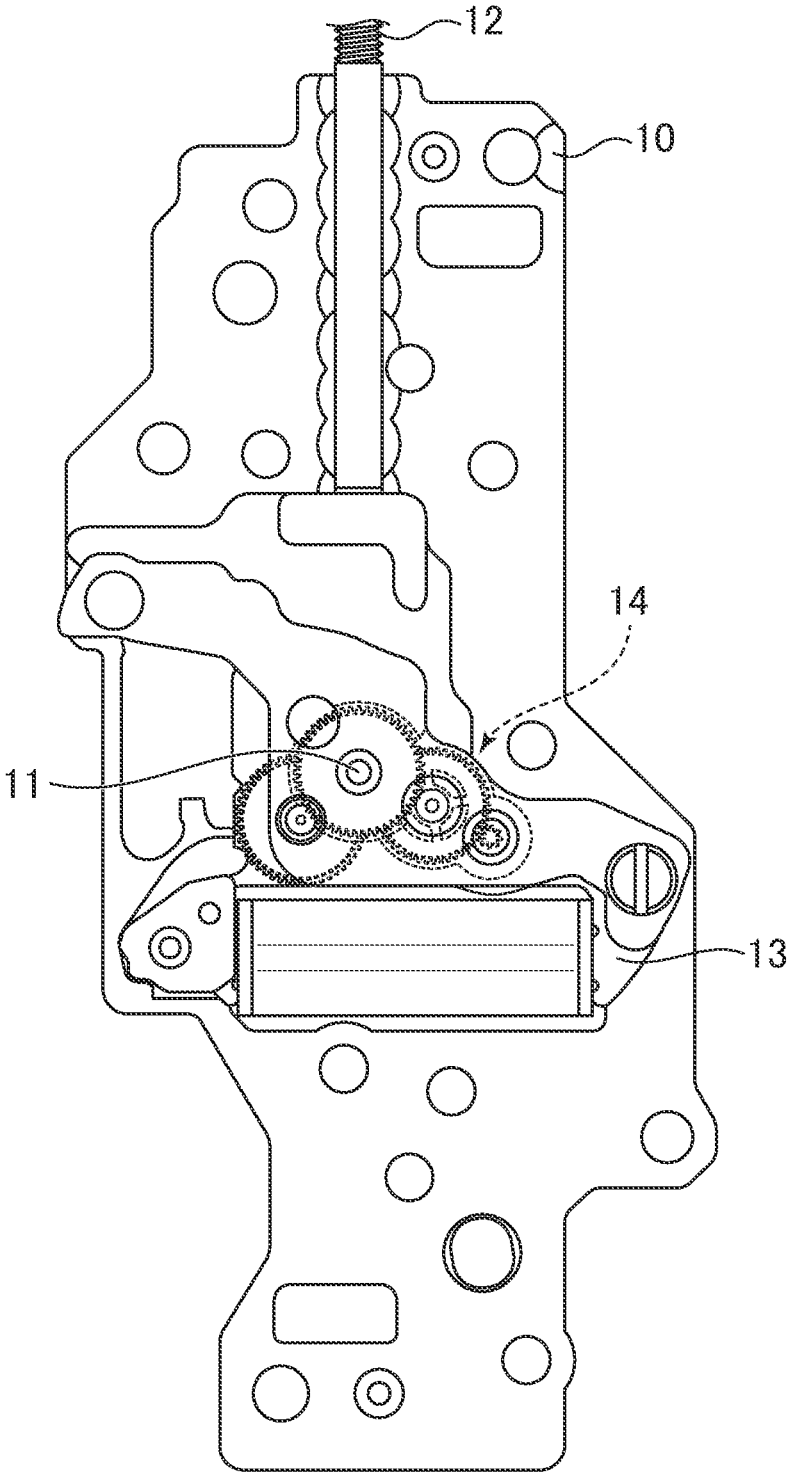
FIG. 4 illustrates an exampled first drive mechanism according to the embodiment of the present invention.

FIG. 4 illustrates an exampled first drive mechanism 10 according to the embodiment of the present invention. The first drive mechanism 10 includes the first hand shaft 11, the winding stem 12, a first stepping motor 13, and a first wheel train 14. The first hand shaft 11 has the rotational axis A along the first direction and works as the hand axis of the hour hand 3*a* and the minute hand 3*b*. The first wheel train 14 is the wheel train constituting the first drive mechanism 10. The first stepping motor 13 is the drive source of the first drive mechanism 10. Drive power of the first stepping motor 13 is transmitted to the first hand shaft 11 through the first wheel train 14.

Since the first drive mechanism 10 is a unit component independent of the other components, the drive mechanism 10 is allowed to be used in another watch. Further, the first drive mechanism 10 can be independently subject to a performance test, and a defective drive mechanism can be excluded before it is mounted in a watch, which improves a product yield rate of the watch 1 efficiently.

Figure 5:
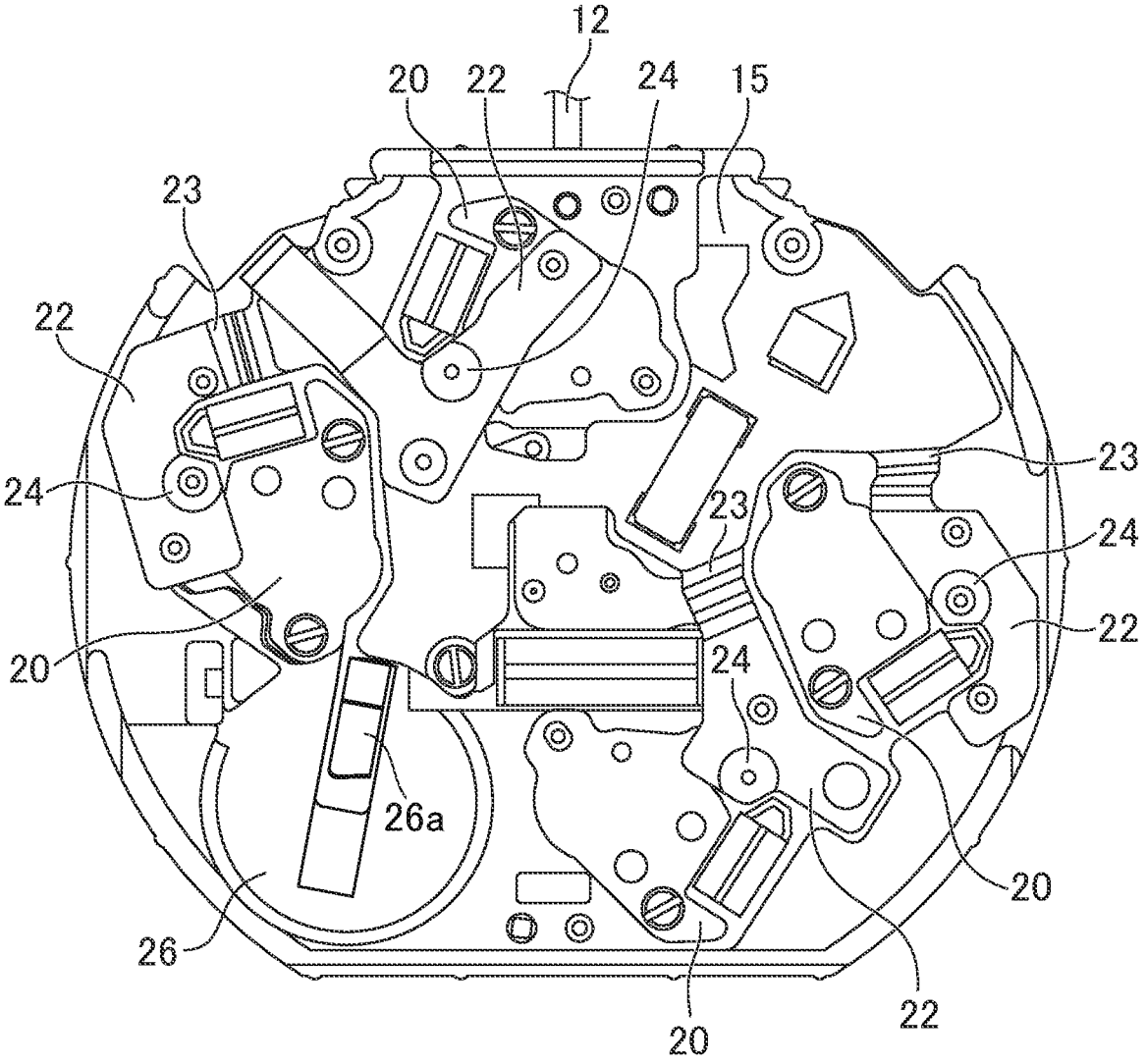
FIG. 5 is a plan view that illustrates, on a side where the back lid is located, an internal structure of the wristwatch of the embodiment according to the present invention.

FIG. 5 is a plan view that illustrates, on the side where the back lid is located, the internal structure of the wristwatch 1 in the embodiment according to the present invention. FIG. 5 illustrates, on the side where the back lid is located, the wristwatch 1 with the 3 o'clock direction thereof directed to the upper side of the figure. The second support plate 41 and the third support plate 42 are omitted from the figure in order to show the layout of the second drive mechanisms 20. In the present embodiment, the second drive mechanisms 20 are arranged in the 12 o'clock position, the 3 o'clock position, and the 6 o'clock position, respectively. That is, the second drive mechanisms 20 are located at positions corresponding to the first sub-hand 4*a*, the second sub-hand 4*b*, the third sub-hand 4*c*, and the fourth sub-hand 4*d*, respectively. FIG. 5 illustrates a battery accommodating portion 26 to have a battery disposed therein that is an electric power source for the first drive mechanism 10 and the second drive mechanisms 20. The battery accommodating portion 26 is formed at the same inclination angle as, or in an inclination angle similar to, the second drive mechanism 20. In the wristwatch 1 according to the present embodiment, the battery to be disposed inside the battery accommodating portion 26 is a primary battery. The battery may be a secondary battery and besides a solar cell for generating electricity may be mounted. In the present embodiment, the battery to be disposed inside the battery accommodating portion 26 is a button cell and arranged such that a carved mark formed on the front surface of the battery is visible. The carved mark on button cells is normally formed on the cathode surface thereof. Accordingly, the battery inside the battery accommodating portion 26 is arranged such that the anode thereof is located on a deep (far) side when viewed in FIG. 5 (that is, located toward the front side of the watch) and such that the cathode thereof is located on a near side when viewed in FIG. 5 (that is, located toward the back side of the watch) and on the lateral side of the button.

The battery accommodating portion 26 has a negative electrode 26*a* located at a deep position thereof. The negative electrode 26*a* becomes in contact with the anode surface of the battery inside the battery accommodating portion 26 to make an electrical connection. In the present embodiment, the negative electrode 26*a* is formed of a tongue-like metal plate that is bent at an angle toward the near side from the far (deep) side inside the battery accommodating portion 26. Thus, when a battery is placed inside the battery accommodating portion 26, the negative electrode 26*a* is pressed to, and is elastically in contact with, the anode of the battery. The negative electrode 26*a* includes a distal edge that is not perpendicular to the extending direction of the negative electrode 26*a*, but is linear and oblique from the extending direction.

The reason is that since the wristwatch 1 itself is curved, the battery is disposed inside the battery accommodating portion 26, being inclined from the thickness direction of the wristwatch 1 (that is, the direction from the front side to the back side of the wristwatch 1). According to the example shown in FIG. 5, the battery is substantially located between the 6 o'clock position and the 9 o'clock position. Accordingly, as is clear from FIG. 1, the battery at the location is inclined such that a portion of the battery toward the 6 o'clock position subsides when the front side of the watch is viewed. As shown in FIG. 5, the direction in which the negative electrode 26*a* extends is not necessarily identical to the direction to which the battery is inclined. The negative electrode 26*a* is bent toward the near side in FIG. 5 (that is, toward the backside of the wristwatch 1 in the thickness direction) and thus is not arranged in the inclined direction of the battery. Therefore, if the distal edge of the negative electrode 26*a* is formed linearly perpendicular to the extending direction of the negative electrode 26*a*, the distal edge of the negative electrode 26*a* could be in point contact through a corner of the negative electrode 26*a* with the anode surface of the battery, which could destabilize the contact and cause a damage due to a torsion force acting on the negative electrode 26*a*. For addressing the problem, the distal edge of the negative electrode 26*a* is formed linearly and obliquely at an appropriate angle from the extending direction, which makes a line contact between the distal edge of the negative electrode 26*a* and the battery when the negative electrode 26*a* is in contact with the anode of the battery. In the present direction, the distal edge of the negative electrode 26*a* is formed in parallel to the 12 o'clock to 6 o'clock direction. The reason is that the battery is inclined toward the 6 o'clock position when the front side of the watch is viewed.

The first drive mechanism 10 and the second drive mechanisms 20 include a first circuit board 15 and second circuit boards 22, respectively. The first circuit board 15 and the second circuit board 22 are connected to each other through a FPC (Flexible Printed Circuit) 23. Each of the first circuit board 15 and the second circuit boards 22 is a so-called rigid circuit board and has such rigidity as to hardly bend even when receiving a force. Whereas, the FPC 23 has flexibility and is allowed to bend. The first circuit board 15, the second circuit boards 22, and the FPC 23 as whole constitute a so-called rigid flexible printed wiring board.

If a single rigid circuit board constitutes a circuit board of the first drive mechanism 10 and the second drive mechanisms 20, it is difficult that the circuit board is mounted in the curved body 6 without an unnecessary space inside there, which causes an unutilized space inside the body 6 and thus unnecessarily increases the thickness of the watch. On the other hand, if a flexible printed circuit constitutes the whole of the first circuit board 15 and the second circuit boards 22, the first drive mechanism 10 and the second drive mechanisms 20, which are inclined from each other, are not stably fixed in position and would need a troublesome process in assembling the components. Unlike the structures described above, employing the first circuit board 15 and the second circuit boards 22 connected through the FPC 23 as seen in the wristwatch 1 according to the present embodiment enables the circuit boards to be arranged inside the curved body 6 without causing unnecessary spaces, while stably fixing the first drive mechanism 10 and the second drive mechanisms 20 at appropriate inclination angles, respectively.

Each of the first circuit board 15 and the second circuit boards 22 includes a ground terminal 24. Providing the ground terminal 24 to each drive mechanism, that is, providing the ground terminals 24 for the stepping motors respectively, enables each drive mechanism to have a stable ground potential. This stabilizes voltages supplied to the motor driving IC's included in the first circuit board 15 and the second circuit boards 22 and thus improves tolerance against, for example, change in static electricity. The first circuit board 15 and the second circuit boards 22 include connection terminals (not shown in the figures) for transmitting signals to the stepping motors on the sides opposite to the ground terminals 24 each formed on the first circuit board 15 and the second circuit boards 22 (that is, the stepping motors on the surfaces opposite to the surfaces on which the ground terminals 24 are disposed respectively). Each ground terminal 24 is electrically grounded by fixing the second support plate 41 to the main plate 30 by a screw. When the second support plate 41 is fixed to the main plate 30, the circuit boards are pressed to the stepping motors to make the electrical connections between the stepping motors and the connection terminals. The structure described above enables the grounding of the circuit board and the electrical connection between the circuit board and the stepping motor to be simultaneously built.

Figure 6:
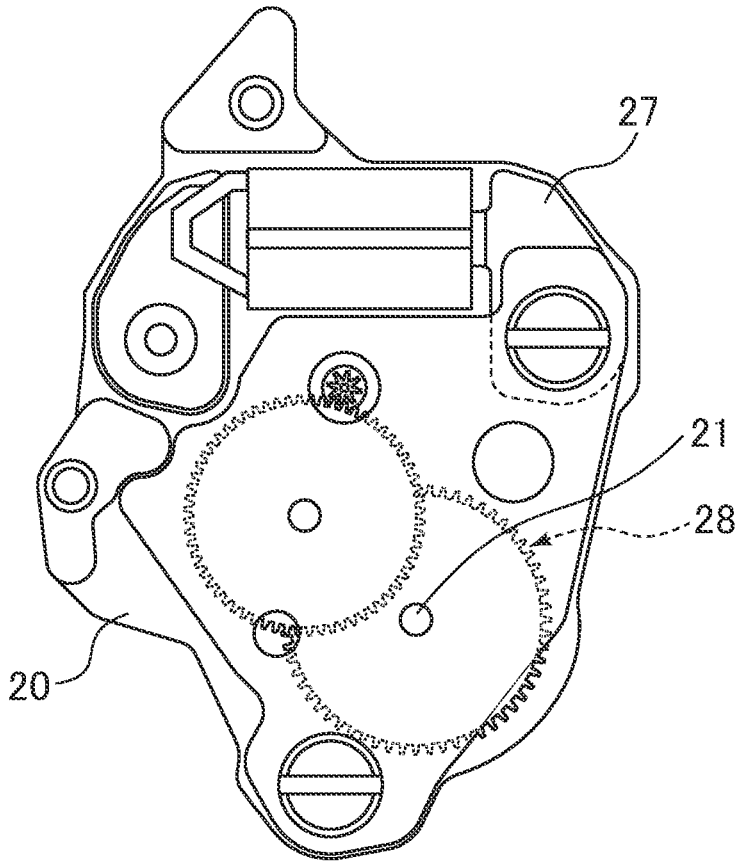
FIG. 6 illustrates an exampled second drive mechanism according to the embodiment of the present invention.

FIG. 6 shows an exampled second drive mechanism 20 according to the present embodiment. The second drive mechanism 20 includes a second hand shaft 21, a second stepping motor 27, a second wheel train 28. The second hand shaft 21 has the rotational axis B along the second direction and is the hand axis of the first sub-hand 4*a*. The second wheel train 28 is the wheel train constituting the second drive mechanism 20. The second stepping motor 27 is the drive power source of the second drive mechanism 20. The drive power generated by the second stepping motor 27 is transmitted to the second hand shaft 21 through the second wheel train 28.

Since the second drive mechanism 20 is a unit component independent of the other components, the drive mechanism is allowed to be used in another watch. Further, the second drive mechanism 20 can be independently subject to a performance test and a defective drive mechanism can be excluded before it is mounted in a watch, which improves a product yield rate of the watch efficiently.

The wristwatch 1 according to the present embodiment is assembled by the following processes. First, the first drive mechanism 10 is disposed inside the first recess 31 of the main plate 30. Then, the first support plate 40 is provisionally fixed to the main plate 30 to press the first drive mechanism 10. The first support plate 40 may include a hook and may be provisionally fixed to the main plate 30 with the hook caught on the main plate 30. This prevents the first drive mechanism 10 from being removed from the first recess 31 and thus allows the main plate 30 to be overturned for a next manufacturing process.

Next, the second drive mechanisms 20 are disposed inside the second recesses 32 of the main plate 30. Then, the first circuit board 15, the second circuit boards 22, and the FPC's 23 are mounted on the main plate 30. The second support plate 41 is fixed to the main plate 30 with a screw, while covering the first circuit board 15, the second circuit boards 22, and the FPC's 23. After that, the first support plate 40, which has been provisionally fixed to the main plate 30, is fixed to the main plate 30 with a screw. Further, the third support plate 42 for enveloping the internal structure is fixed to the main plate 30 with a screw, covering the second support plate 41.

Figure 7:
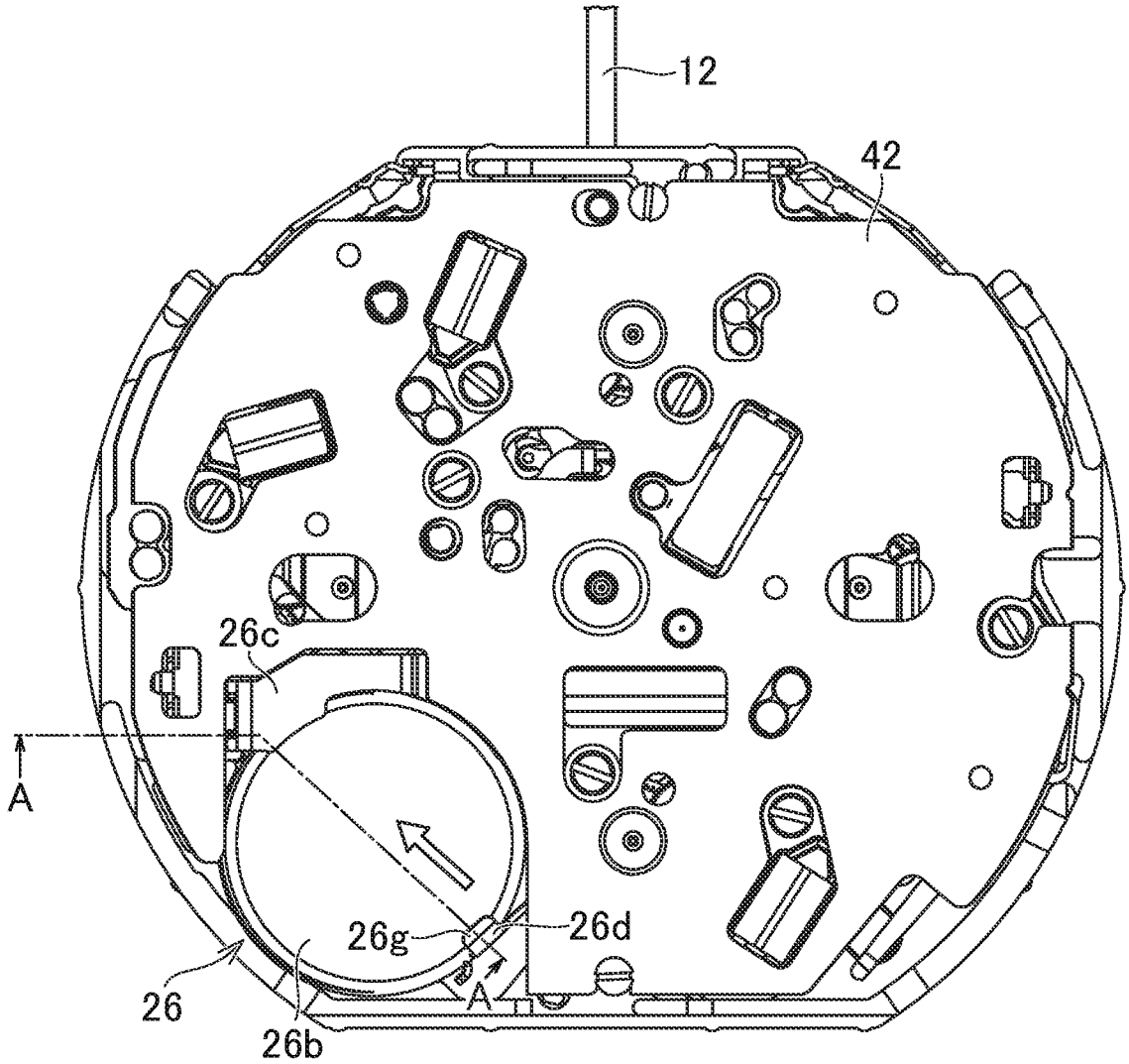
FIG. 7 is a plan view that illustrates, on a side where the back lid is located, the internal structure of the wristwatch according to the embodiment of the present invention.
Figure 8:
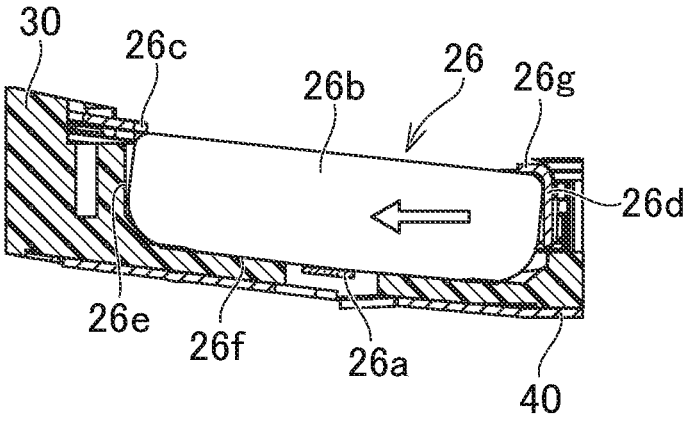
FIG. 8 is a cross-sectional view taken along A-A line indicated in FIG. 7.

FIG. 7 is a plan view that illustrates, on the back side, the internal structure of the wristwatch 1 according to the embodiment of the present invention. The figure illustrates, on the back side, the internal structure in which a battery 26*b* is disposed inside the battery accommodating portion 26 and to which the second support plate 41 and the third support plate 42 are attached. In the figure, the second support plate 41 is covered by the third support plate 42 and thus not shown. FIG. 8 is a cross-sectional view taken along A-A line indicated in FIG. 7.

The battery 26*b* is disposed inside the battery accommodating portion 26, being inclined such that a portion thereof toward the 6 o'clock position subsides when the front side of the watch is viewed. A perpendicular line to a flat surface of the battery 26*b* (that is, the anode surface or the cathode surface thereof is substantially in parallel with the rotational axis C. The incline of the battery 26*b* enables the battery 26*b* to be disposed inside the main plate 30 in conformity with the curvature of the main plate 30 and contributes toward thinning the wristwatch 1 down. For example, for the structure in which the main plate 30 curves from the 12 o'clock to 6 o'clock direction and the first drive mechanism 10 is located spreading between the 3 o'clock position and the 9 o'clock position, it is preferable for reducing the thickness of the wristwatch 1 that the battery 26*b* is arranged causing no interference with the first drive mechanism 10. Since the position of the battery is inclined from the thickness direction of the wristwatch 1 due to the curvature of the main plate 30, inclining the battery 26*b* in conformity with the incline of the main plate 30 reduces the thickness of the wristwatch 1. Further, for the structure in which the second drive mechanisms 20 are located in the 12 o'clock position and the 6 o'clock position as shown in the present embodiment, it is preferable that the battery 26*b* is arranged causing no interference with the second drive mechanisms 20. With this regard, the battery 26*b* may be disposed at a position between the 12 o'clock position and the 3 o'clock position, at a position between the 3 o'clock position and the 6 o'clock position, at a position between the 6 o'clock position and the 9 o'clock position, or at a position between the 9 o'clock position and the 12 o'clock position. In the present embodiment, the battery 26*b* is disposed at the position between the 6 o'clock position and the 9 o'clock position.

The battery 26*b* is elastically fixed in the battery accommodating portion 26 by a first battery pressing member 26*c* and the second battery pressing member 26*d* not so as to be removed therefrom. The first battery pressing member 26*c* is a metal plate located on the cathode surface of the battery and supporting a portion of a peripheral portion of the cathode surface. In the present embodiment, when viewed in FIG. 7, the first battery pressing member 26*c* supports a portion of the battery located on a left and upper side thereof (that is, on a side ranging from the 4 o'clock position to the 5 o'clock position defined around the center of the battery 26*b*). The second battery pressing member 26*d* elastically presses the side surface of the battery 26*b* toward the first battery pressing member 26*c*. The second battery pressing member 26*d* is preferably arranged on a side almost opposite to the first battery pressing member 26*c* across the center of the battery 26*b*. In the present embodiment, when viewed in FIG. 7, the second battery pressing member 26*d* is located on a right and lower side of the battery (that is, on a side ranging from the 10 o'clock position to the 11 o'clock position defined around the center of the battery 26*b*). The battery pressing member 26*d* is formed of a metal plate which has a suitable shape and on which a bending process has been carried out. A tongue-like metal plate is formed, as the battery pressing member 26*d*, in parallel to the thickness direction of the wristwatch 1 and presses the side surface of the battery 26*b* by the elasticity thereof in a direction indicated by an outlined arrow shown in FIG. 7. The battery pressing member 26*d* includes a projection 26*g* that projects to catch a portion of the cathode surface of the battery 26*b* in order to prevent the removing of the battery 26*b*. The layout of the first battery pressing member 26*c* and the second battery pressing member 26*d* is designed to stably fix the battery 26*b* and surly make the electrical connection to the cathode thereof. The layout thereof will be described later.

The battery accommodating portion 26 is a recess formed in the main plate 30, and includes an accommodating portion wall 26*e* formed in parallel to a common direction or formed like a taper inclined from a common direction. The common direction described here is identical to the common direction for the first recess 31 and the second recess 32. In the present embodiment, the common direction corresponds to the first direction (that is, the direction along the rotational axis A). Accordingly, the battery accommodating portion 26 includes the accommodating portion wall 26*e* formed like a taper inclined from the first direction (that is, the direction along the rotational axis A). Since the battery accommodating portion 26 opens toward the back side of the watch, the accommodating portion wall 26*e*, which is formed like a taper, is formed such that the battery accommodating portion 26 widens toward the back side. Like the taper of the first recess 31 and the second recess 32 described above, the taper of the accommodating portion wall 26*e* is a so-called draft angle for injection molding of the main plate 30. The accommodating portion wall 26*e* formed like a taper inclined from the common direction facilitates the injection molding of the main plate 30.

The battery accommodating portion 26 includes an accommodating portion bottom 26*f*. The battery 26*b* is fixed such that the anode surface (flat surface) is in contact with the accommodating portion bottom 26*f*. Each the anode surface of the battery 26*b* and the accommodating portion bottom 26*f* is a flat surface. Further, when the battery 26*b* is disposed inside the battery accommodating portion 26, the anode surface thereof is fixed in contact with the accommodating portion bottom 26*f*. Accordingly, the inclination angle of the battery 26*b* corresponds to the inclination angle of the accommodating portion bottom 26*f*. In this situation, the second battery pressing member 26*d* is preferably located at a far (low) position in a view from the back side of the watch (that is, in a view from the opening of the battery accommodating portion 26) in the inclined direction of the battery 26*b*. That is, the second battery pressing member 26*d* is preferably located at a near position in a view from the front side of the watch. The second battery pressing member 26*d* at the position presses the side surface of the battery 26*b*. The first battery pressing member 26*c* is preferably located at a near position in a view from the back side of the watch 1 (that is, a far (deep) position in a view from the front side of the watch) in the inclined direction of the battery 26*b*, and supports the cathode surface of the battery 26*b*.

The reason for the above arrangement will be described with reference to FIG. 8. As shown in the figure, the second battery pressing member 26*d* is located at a far position in a view from the back side of the watch and presses the battery 26*b* in the lateral direction, as indicated by the outlined arrow. In this situation, the accommodating portion bottom 26*f* is inclined from the pressing direction of the second battery pressing member 26*d*, ascending toward the near side in a view from the back side of the watch, and thus the pressure of the second battery pressing member 26*d* pushes up the battery 26*b* toward the back side of the watch. Specifically, a portion within the battery 26*d* opposite to the second battery pressing member 26*d* receives a force to remove the portion from the battery accommodating portion 26 toward the back side of the watch. However, the portion is provided with the first battery pressing member 26*c*. Accordingly, the pressing force of the second battery pressing member 26*d* strongly acts on, and pushes, the battery 26*b* toward the first battery pressing member 26*c* to fix the battery 26*b* stably. Therefore, the cathode of the battery 26*b* is in strong contact with the two members, that is, the first battery pressing member 26*c* and the second battery pressing member 26*d*. Accordingly, using both first battery pressing member 26*c* and second battery pressing member 26*d* as the positive terminals for the battery 26*b* enables a reliable electrical connection.

In the example of the present embodiment, the farthest position within the battery 26*b* in a view from the back side of the watch is located at the 12 o'clock position, and accordingly the position of the second battery pressing member 26*d* is preferably defined in a half circumferential area of the battery 26*b* toward the 12 o'clock position, that is, defined in an area ranging from the 9 o'clock position to the 3 o'clock position through the 12 o'clock position. The closer to the 12 o'clock position the second battery pressing member 26*d* is located, the higher the benefit that the battery 26*b* is stably fixed and that the electrical connection to the cathode is reliable is. The position of the first battery pressing member 26*c* is preferably defined in a half circumferential area of the battery 26*b* toward the 6 o'clock position, that is, defined in an area ranging from the 3 o'clock position to the 9 o'clock position through the 6 o'clock position. In the present embodiment, the second battery pressing member 26*d* is located between the 10 o'clock position and the 11 o'clock position, and the first battery pressing member 26*c* is located opposite thereto and between the 4 o'clock position and the 5 o'clock position.

An embodiment according to the present invention have been described above. However, the specific structure shown in this embodiment is described as an example of the present invention, and thus the scope of the present invention is not limited to this structure. For example, in the wristwatch 1 according to the present embodiment, the body 6, the dial 2, etc. curves gradually. However, the dial 2 may be bent at an obtuse angle. In this structure, the dial 2 may include plural flat surfaces in the single dial surface thereof and the hands may be provided on the flat surfaces, respectively. A wristwatch has been described as the embodiment. However, the same structure may also be applied to other watches such as a pocket watch etc. A skilled person in the art may appropriately modify the described embodiment. The scope of the invention disclosed in the present specification should be understood as including the modifications.

The invention claimed is:

1. A watch comprising:

a first drive mechanism including a 1st hand having a rotational axis along a first direction, a wheel train, and a drive power source, and a second drive mechanism including a 2nd hand having a rotational axis along a second direction different from the first direction, wherein the first drive mechanism and the second drive mechanism are mounted separately, wherein the watch further comprises a main plate including a first attachment surface and a second attachment surface having different orientations from each other, wherein the first drive mechanism is fixed such that a standard surface thereof is in contact with the first attachment surface, and the second drive mechanism is fixed such that a standard surface thereof is in contact with the second attachment surface.

2. The watch according to claim 1, wherein the first direction is defined along a normal direction to a dial at a position of the rotational axis of the 1st hand, and the second direction is defined along the normal direction to the dial at a position of the rotational axis of the 2nd hand.

3. The watch according to claim 1, wherein the main plate includes at least a first recess and a second recess, a bottom surface of the first recess is the first attachment surface, and a bottom surface of the second recess is the second attachment surface.

4. The watch according to claim 3, wherein the first recess and the second recess include wall surfaces that are formed in parallel to a common direction or inclined from a common direction.

5. The watch according to claim 3, wherein the first recess and the second recess are formed on surfaces of the main plate, opposite to each other.

6. The watch according to claim 1, wherein the main plate further comprises:

a battery, and a battery accommodating portion, and the battery is located inside the battery accommodating portion and is fixed in a position inclined from a thickness direction of the watch.

7. The watch according to claim 4, wherein the main plate further comprises:

a battery accommodating portion, a battery located inside the battery accommodating portion, wherein the battery is fixed in an inclined position, from a thickness direction of the watch, and the battery accommodating portion includes a wall surface that is formed in parallel to the common direction or formed with a taper, inclined from the common direction.

8. The watch according to claim 6, further comprising:

a first battery pressing member located on a near side, when viewed from an opening side of the battery accommodating portion, located at a circumferential position thereof, and supporting an upper surface of the battery; and a second battery pressing member located on a far side, when viewed from the opening side of the battery accommodating portion, and pressing a lateral side surface of the battery.

9. The watch according to claim 6, further comprising an electrode extending and including a linear distal edge that is oblique from an extending direction thereof and is in elastic contact with a lower surface of the battery.

10. The watch according to claim 1, wherein the first drive mechanism and the second drive mechanism include circuit boards, respectively, and the circuit board of the first drive mechanism and the circuit board of the second drive mechanism are connected to each other through a flexible printed circuit.

11. The watch according to claim 10, wherein the circuit board of the first drive mechanism and the circuit board of the second drive mechanism include connection terminals, respectively.

* * * * *